US006668064B1

(12) United States Patent
Lin

(10) Patent No.: US 6,668,064 B1
(45) Date of Patent: Dec. 23, 2003

(54) EARPHONE WITHOUT IMPULSE NOISE AND SURROUNDING BLOCKADE

(76) Inventor: Chung Yu Lin, 29, Tunnel 152, Kuang Hwa 1 Rd., Kaohsiung (TW)

( * ) Notice: Subject to any disclaimer, the term of this patent is extended or adjusted under 35 U.S.C. 154(b) by 0 days.

(21) Appl. No.: 09/345,135

(22) Filed: Jul. 6, 1999

(51) Int. Cl.[7] ..... H04R 25/00
(52) U.S. Cl. ..... 381/380; 381/328; 381/373
(58) Field of Search ..... 381/370, 371, 381/373, 374, 380, 309, 328, FOR 149, FOR 150, FOR 133; 181/129, 130, 135

(56) References Cited

U.S. PATENT DOCUMENTS 4,239,945 A * 12/1980 Atoji et al. ..... 381/371
4,736,435 A * 4/1988 Yokoyama
5,729,605 A * 3/1998 Bobisuthi ..... 381/183
5,781,638 A * 7/1998 Hosaka ..... 381/187
5,790,683 A * 8/1998 Salzani ..... 381/183
5,844,998 A * 12/1998 Nageno ..... 381/371
5,867,582 A * 2/1999 Nagayoshi ..... 381/370
5,949,896 A * 9/1999 Nageno

* cited by examiner

*Primary Examiner*—Huyen Le
(74) *Attorney, Agent, or Firm*—Raymond Y. Chan; David and Raymond Patent Group

(57) ABSTRACT

The present invention is to provide an earphone without impulse noise and surroundings blockade consists of an earphone housing having a sound chamber inside thereof and a loudspeaker mounted therein, wherein a plurality of sound outlet meshes is mounted in the front end of the earphone housing, and a proper distance is given between the front end of the earphone housing and the loudspeaker mounted therein, wherein a plurality of sound inlet meshes is mounted on and encircled the earphone housing within the proper distance; and the lower impulse noise output end according to two output ends of the loudspeaker is faced to the sound outlet meshes; via the design, the present invention can prevent not only the impulse noise directly impact to the middle ear but also the damage of the middle ear and the cause of conductive hearing loss.

1 Claim, 3 Drawing Sheets

EARPHONE WITHOUT IMPULSE NOISE AND SURROUNDING BLOCKADE

BACKGROUND OF THE PRESENT INVENTION

1. Field of Invention

The present invention relates to an earphone, and more particularly to an earphone without impulse noise surroundings blockade, wherein the sound outside can be caught by the human ear so that any events outside are able to be realized at once without taking off the earphone; the present invention will also against conductive hearing loss caused by the direct impact of the impulse noise.

2. Description of Related Arts

A ordinary earphone, referring FIGS. 1 to 3 of the drawings, comprises a earphone housing 10, a loudspeaker 20, and a sound outlet cover 30, wherein the earphone housing 10 comprising a sound chamber 11 and an open-end 12, and thereof the loudspeaker 20 is mounted on the sound chamber 11 of the earphone housing 10. The sound outlet cover 30 is affixed on the open-end 12 of the earphone housing 10, and thereof a plurality of sound outlet meshes 31 is mounted on the surface of the sound outlet cover 30. The impulse noise output end 21 of the loudspeaker 20 is faced to the sound outlet meshes 31 of the sound outlet cover 30. When the earphone is hanged between a tragus A1 and an antitragus A2 of the human ear A (as shown in FIG. 1), sound emitted from the loudspeaker 20 will transmit through the sound outlet meshes to the human ear.

Form the above, it is realized that when people are using the ordinary earphone, the sound emitted by the loudspeaker 20 will all transmit through the meshes 31 of the sound outlet cover 30 to the human ear A. The sound from outside cannot pass through the earphone housing 10 and cannot combine the sound emitted by the loudspeaker 20 together and then transmit to the human ear A. So, when people wear the ordinary earphone, they can only hear the sound from the loudspeaker 20 and will completely be blocked hearing and knowing from outside which can in danger their lives especially while they are driving or walking on the street.

Furthermore, in 1997, UT Southwestern Medical Center stated: "approximate 20% of American Teen, between 13–19 have hearing disability. The major cause of the hearing loss is people exposed to the noise especially the impulse noise from the earphone." People should concern the control of the sound volume while using the traditional earphone (continuous hearing not more than one hour or six hours per day when sound pressure at 105 dB or 95 dB respectively). In fact, this flash impulse noise contains high sound pressure and may damage the eardrum or middle ear hearing loss. It is called Conductive Hearing Loss. America's medical report recently stated that the percentage of people having the Conductive Hearing Loss is gradually increasing since earphones are improperly used listen to the hot music such as Rock and Roll.

So, sound emitted by an ordinary earphone contains impulse noise. When an ordinary earphone is used, the impulse noise will directly impact to the external auditory canal B of the human ear A and make people feel uncomfortable. The continuous use of an ordinary earphone will cause the damage of the middle ear and the cause of hearing loss to the people.

SUMMARY OF THE PRESENT INVENTION

The main object of the present invention is to provide an earphone without impulse noise and surroundings blockade, wherein the earphone is adapted for the sound from outside passing through the earphone housing, and combine with the sound emitted by the loudspeaker then transmit to the human ear. While the present invention is used to listen to the music, people are still able to hearing the sound and realizing the events outside to keep away from dangerous. The present invention will cover the disadvantage of the ordinary earphone which is completely block hearing from outside.

Another object of the present invention is to provide an earphone without impulse noise and surroundings blockade, wherein sound emitted by the present invention does not contain any impulse noise. When the earphone is used to listen music, the present invention can prevent not only the impulse noise directly impact to the middle ear but also the damage of the middle ear and the cause of hearing loss.

DETAILED DESCRIPTION OF THE PREFERRED EMBODIMENT

Figure 1:
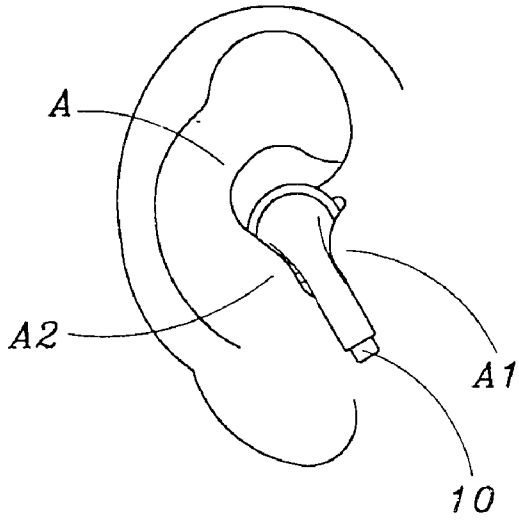
FIG. 1 Prior Art
FIG. 1 is a perspective view of the ordinary earphone hanged on the human ear.
Figure 2:
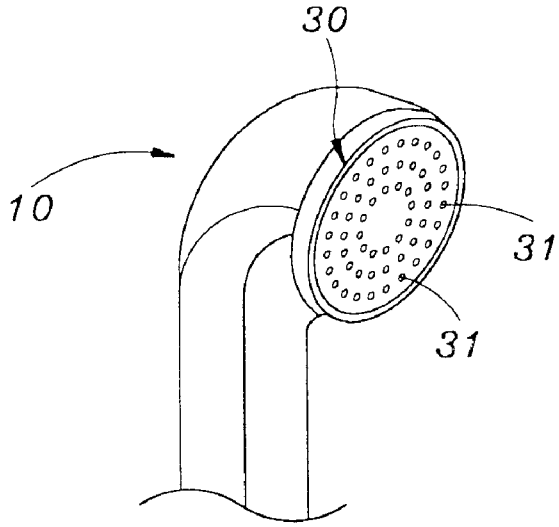
FIG. 2 Prior Art
FIG. 2 is a perspective view of the ordinary earphone.
Figure 3:
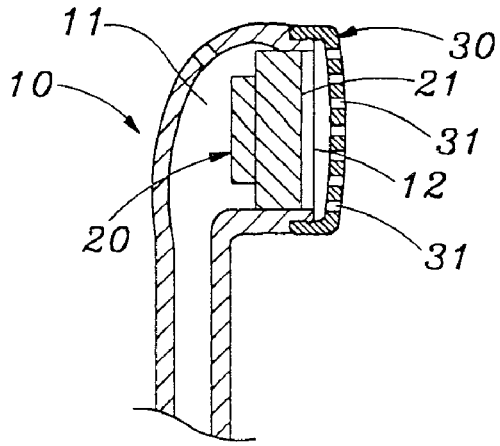
FIG. 3 Prior Art
FIG. 3 is a cross-sectional view of the ordinary earphone.
Figure 4:
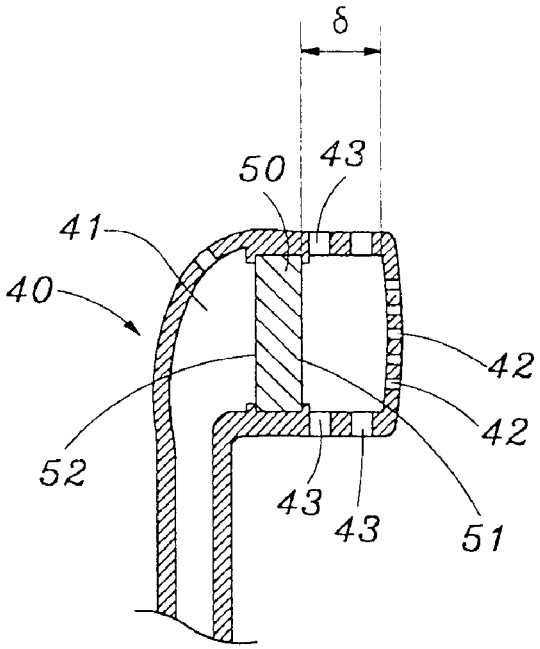
FIG. 4 is a cross-sectional view of an earphone-speaker according to an example of a preferred embodiment of the present invention.

Referring to FIG. 4 of the drawing, an earphone without impulse noise and surroundings blockade in accordance with the present invention comprises an earphone housing 40 having a sound chamber 41 inside thereof and a loudspeaker 50 mounted therein, wherein a plurality of sound outlet meshes 42 is mounted in the front end of the earphone housing 40, and a proper distance δ is given between the front end of the earphone housing 40 and the loudspeaker 50 mounted therein, wherein a plurality of sound inlet meshes 43 is mounted on and encircled the earphone housing 40 within the proper distance δ; and the lower impulse noise output end according to two output ends of the loudspeaker 50 is faced to the sound outlet meshes 42 mounted in the front end of the earphone housing 40.

Figure 5:
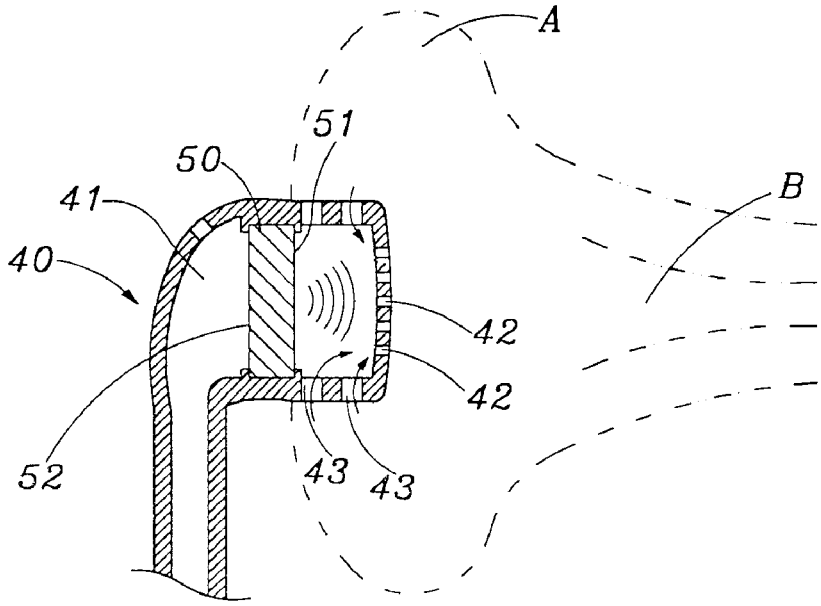
FIG. 5 is of a cross-sectional view of an earphone-speaker according to another example of the above preferred embodiment the present invention.

Referring to FIG. 5, when the present invention is used, the front end of the earphone housing 40 is adapted for hanging fitly between a tragus A1 and an antitragus A2 of human ear A. When the earphone is used to listen to the music, sound from outside will pass through the sound inlet meshes to the earphone housing. The sound then combines with the sound emitted by the loudspeaker 50 together and transmit to the external auditory canal B of the human ear A. So, people will not only listen to the music produced by the loudspeaker 50 but also realize the events outside on the alert. Moreover, the lower impulse noise output end 51 according to two output ends of the loudspeaker 50 is faced to the sound outlet meshes 42, and the sound, which combined with the surroundings and the loudspeaker 50, transmitted to the external auditory canal do not contain high impulse noise. That is, the unpleasant feeling made by the impact of the impulse noise will not happen to the people loving to use earphone for a long period and the sound will not cause conductive hearing loss and damage the middle ear as well.

Figure 6:
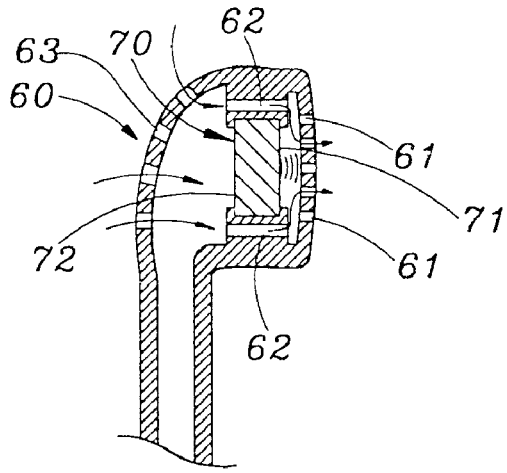
FIG. 6 is a cross-sectional view of the housing of another embodiment of the present invention.

Referring to FIG. 6, an earphone without impulse noise and surroundings blockade in accordance with the housing of another embodiment the present invention comprises an earphone housing 60 having a sound chamber inside thereof and a loudspeaker 70 mounted therein, wherein a plurality of sound outlet meshes 61 is mounted in the front end of the earphone housing 60, a plurality of hollow meshes 62 is mounted on the inner surface of the sound chamber of the earphone housing 60 where the loudspeaker 70 mounted therein; and the lower impulse noise output end according to two output ends of the loudspeaker 70 is faced to the sound outlet meshes 61; a plurality of sound inlet meshes 63 is mounted on the top portion and the surface of rear portion of the earphone housing 60. So, sound from outside can pass through the sound inlet meshes 61 to the earphone housing 60, and transmit through the hollow meshes 62 and sound outlet meshes 61 to the human external ear. People are able to receive the sound outside and realize the events outside at once without taking off the earphone. Furthermore, the earphone will only generate sound with low impulse noise which will not give any unpleasant feeling for people, and also avoid the damage of the human middle ear and the cause of hearing loss.

What is claimed is:

1. An earplug type earphone for plugging in a human ear, comprising:

an earphone housing having a rear end and a front end which is adapted for hanging fittingly between a tragus and an antigragus of the human ear, wherein a sound chamber is defined between said front end and said rear end inside said earphone housing; and a loudspeaker, which is mounted in said earphone housing, having an original sound output end faced to said rear end of said earphone housing and a lower impulse noise output end faced to a front surface of said front end of said earphone housing, wherein a predetermined distance is defined between said loudspeaker and said front end of said earphone housing and said sound chamber is divided by said loudspeaker into a front chamber defined between said loudspeaker and said front end of said earphone housing and a rear chamber defined between said loudspeaker and said rear end of said earphone housing;

wherein a plurality of sound outlet meshes is provided on a front surface of said front end of said earphone housing and a plurality of hollow meshes is provided around said loudspeaker to enable said rear chamber communicating with said front chamber, wherein a plurality of sound inlet meshes is provided on a peripheral side around said rear end of said earphone housing for communicating said rear chamber with outside, wherein said sound inlet meshes are arranged to enable exterior sound from outside passing therethrough into said rear chamber of said earphone housing and transmitting into said front chamber through said hollow meshes to combine with interior sound emitted into said front chamber by said loudspeaker together before emitting into said human ear through said sound outlet meshes.

* * * * *